US007681671B2

(12) United States Patent
Lim

(10) Patent No.: US 7,681,671 B2
(45) Date of Patent: Mar. 23, 2010

(54) DRILLING APPARATUS HAVING IN-LINE EXTENDING WINGS AND DRIVING METHOD THEREOF

(76) Inventor: Byung-Duk Lim, Seoho Apt. 105-1104, Songcheon-dong 1ga, Deokjin-ku, Jeonju-si, Jeollabuk-do, Jeonju (KR) 561-301

( * ) Notice: Subject to any disclaimer, the term of this patent is extended or adjusted under 35 U.S.C. 154(b) by 457 days.

(21) Appl. No.: 11/574,026

(22) PCT Filed: Sep. 2, 2005

(86) PCT No.: PCT/KR2005/002918

§ 371 (c)(1),
(2), (4) Date: Feb. 21, 2007

(87) PCT Pub. No.: WO2006/025713

PCT Pub. Date: Mar. 9, 2006

(65) Prior Publication Data

US 2009/0188719 A1 Jul. 30, 2009

(30) Foreign Application Priority Data

Sep. 3, 2004 (KR) ..... 10-2004-0070565

(51) Int. Cl.
*E21B 10/32* (2006.01)

(52) U.S. Cl. ..... 175/384; 175/382; 175/385; 175/263

(58) Field of Classification Search ..... 175/382, 175/384, 385, 263, 279, 273
See application file for complete search history.

(56) References Cited

FOREIGN PATENT DOCUMENTS

KR 10-2003-0065052 * 8/2003

* cited by examiner

*Primary Examiner*—David J Bagnell
*Assistant Examiner*—Sean D Andrish

(57) ABSTRACT

The present invention relates to a borehole drilling apparatus with in-line extending wings and driving method thereof. The drilling apparatus comprises a guide device rotating while moving upwardly and downwardly in a casing to fit into a borehole, extending wings for extending the diameter of a drilled hole, and a pilot bit installed at a lower portion of the guide device to strike the bottom of the borehole, wherein spiral projections formed at a lower surface of the guide device slidably engage with guide grooves formed at a side of the extending wings to each other, and a window is formed at a side of the pilot bit for advancing and retracting the extending wings so that they can spread and return linearly from the center of the pilot bit.

4 Claims, 6 Drawing Sheets

DRILLING APPARATUS HAVING IN-LINE EXTENDING WINGS AND DRIVING METHOD THEREOF

TECHNICAL FIELD

The present invention relates to a borehole drilling apparatus having in-line extending wings and driving method thereof, in particular to a borehole drilling apparatus having in-line extending wings, which comprises a guide device operated by high pressure air, extending wings and a pilot bit, the extending wings being configured to advance and retract in an in-line manner so as to extend the diameter of a borehole so that sludge can be prevented from being accumulated in the space to which the extending wings return, and a driving method thereof.

BACKGROUND ART

In general, hammer bit equipment used in drilling a borehole includes a rotation apparatus, a striking apparatus and a drilling apparatus. The present invention is directed to the drilling apparatus located at the lowest portion of the hammer bit equipments. The drilling apparatus can be divided into an eccentric type, an extending type and a blade extending type depending on means for extending the diameter of the borehole, for instance, the structure of a reamer, extending blades or arms.

As disclosed in U.S. Pat. No. 4,770,259 (Published on Sep. 13, 1988), the eccentric type drilling apparatus includes a drill string and a cutting device connected to a lower end portion of the drill string. Further, the cutting device consists of an intermediate portion rotating within the drill string, and an outer surface. Also, a reamer is installed in the intermediate portion so that it is offset with regard to the center axis. Accordingly, the reamer extends the diameter of the borehole by eccentric rotation in the eccentric type drilling apparatus.

In addition, as shown in Japanese Patent Laid-Open Publication No. 2710192 (published on Nov. 29, 1994), the extending type drilling apparatus comprises a device driven by means of an air pump, a bit device installed at a distal end of the device, and an extending blade installed between the device and the bit device. The extending blade is secured at an upper end to the device by means of a pin so that it can move angularly in the vertical direction, and the upper end portion of the bit device is formed to have an inclined surface. Therefore, the lower end portion of the extending blade is configured to diverge along the inclined surface of the bit device when the device and the bit device come close to each other.

Further, as shown in U.S. Pat. No. 5,787,999 (issued on Aug. 4, 1998), the blade extending type drilling apparatus includes a driver, under-reamer arms, and a pilot bit, in which a plurality of arms are constructed to project and retract while rotating from the center of the pilot bit to the inclined direction by means of a rotation force of the driver.

However, with regard to the eccentric type drilling apparatus, it is impossible to carry out rapid drilling work as the reamer rotates eccentrically, and there is a problem in that connection portion of the intermediate portion is liable to be damaged easily under high load. Also, with regard to the extending type drilling apparatus, it is impossible to use it under high load as the extending blade is extended with its angular movement to the longitudinal direction, and the fixing pin is apt to be damaged easily.

Further, in contrast to the eccentric or extending type drilling apparatus, although the blade extending type drilling apparatus can be used for high load drilling apparatus, there is a problem in that the contact portion between the arms and the pilot bit is susceptible to serious abrasion because the rotation force of the driver should spread the arms forcibly and rotate even the pilot bit via the arms at the same time, and the securing pin for fixing the arms are damaged frequently. Additionally, when the arms return to their original positions after the completion of the drilling work, sludge is liable to be jammed in the space where the arms return to thereby hinder the arms' return to their original positions, so that it becomes somewhat difficult to retract the drilling apparatus from the casing to fit into the borehole.

DISCLOSURE OF INVENTION

Technical Problem

The present invention has been made to solve the above-mentioned problems occurring in the conventional striking type borehole drilling apparatus, and it is an object of the present invention to provide a borehole drilling apparatus of an improved structure, in which it is possible to perform a drilling work under a high load and at a high speed, it is easy to spread and return the extending wings, the working efficiency is excellent as the sludge is not accumulated in the space where the extending wings return, and it is possible to significantly reduce the maintenance and repair costs.

Technical Solution

To accomplish the above object, according to one aspect of the present invention, there is provided a borehole drilling apparatus and driving method thereof, wherein the borehole drilling apparatus comprises a guide device rotating with moving up and down in a casing to fit into the borehole, extending wings for extending the diameters of the drilled holes, and a pilot bit installed at a lower portion of the guide device to strike the bottom of the borehole, wherein spiral projections formed at a lower surface of the guide device slidably engage with guide grooves formed at sides of the extending wings to each other, and a window is formed at a side of the pilot bit for advancing and retracting the extending wings so that they can spread and return linearly from the center of the pilot bit.

In the present invention, as described above, the term of "In-line" driving manner refers to a manner in which the extending wings spread from each other linearly from the center of the pilot bit, and they return to come close to each other linearly.

BRIEF DESCRIPTION OF DRAWINGS

Further objects and advantages of the present invention can be more fully understood from the following detailed description taken in conjunction with the accompanying drawings in which.

BEST MODE FOR CARRYING OUT THE INVENTION

The present invention will hereinafter be described in further detail with reference to the preferred embodiments.

Figure 1:
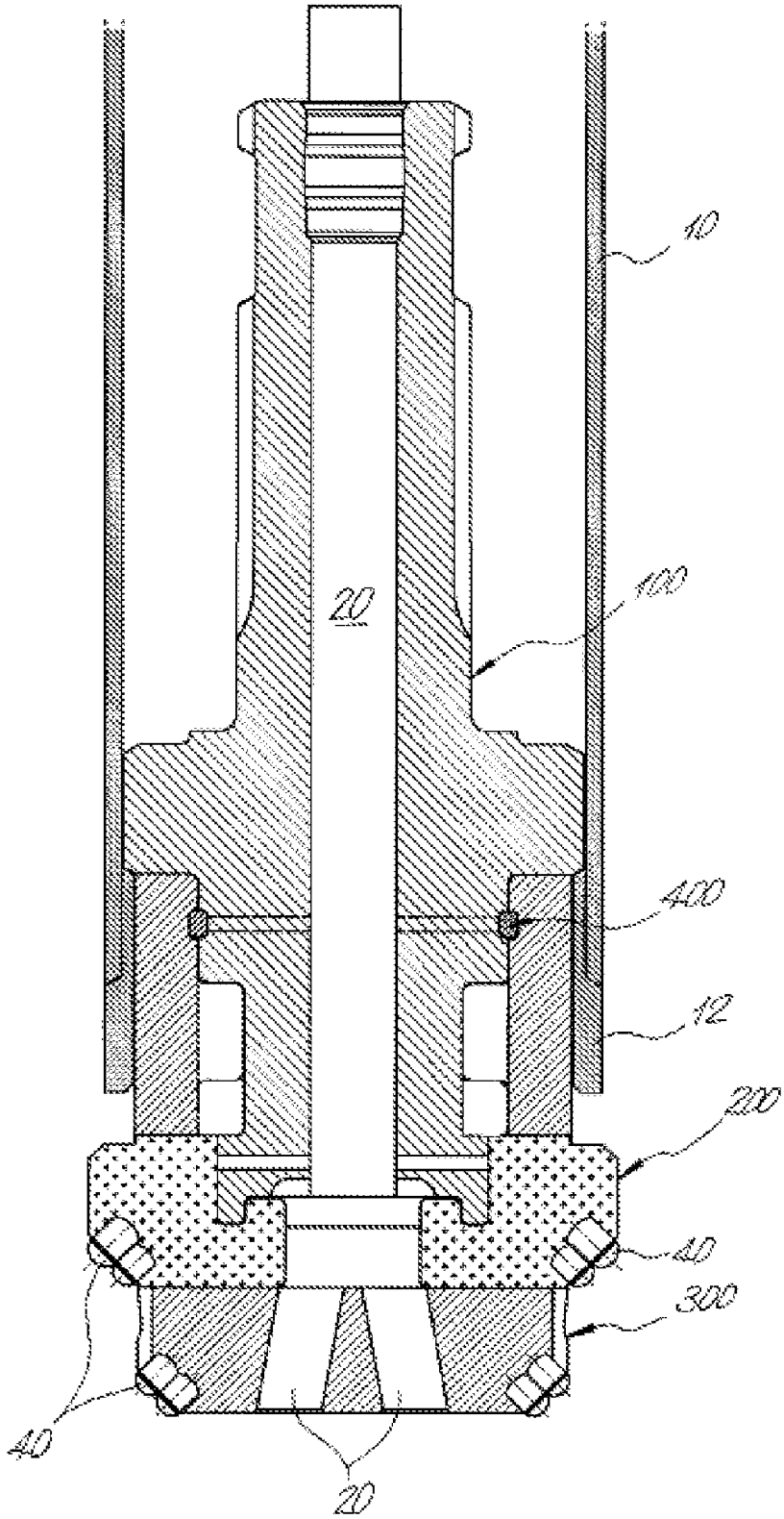
FIG. 1 is a cross-sectional view showing structure of a borehole drilling apparatus according to the present invention.
Figure 2:
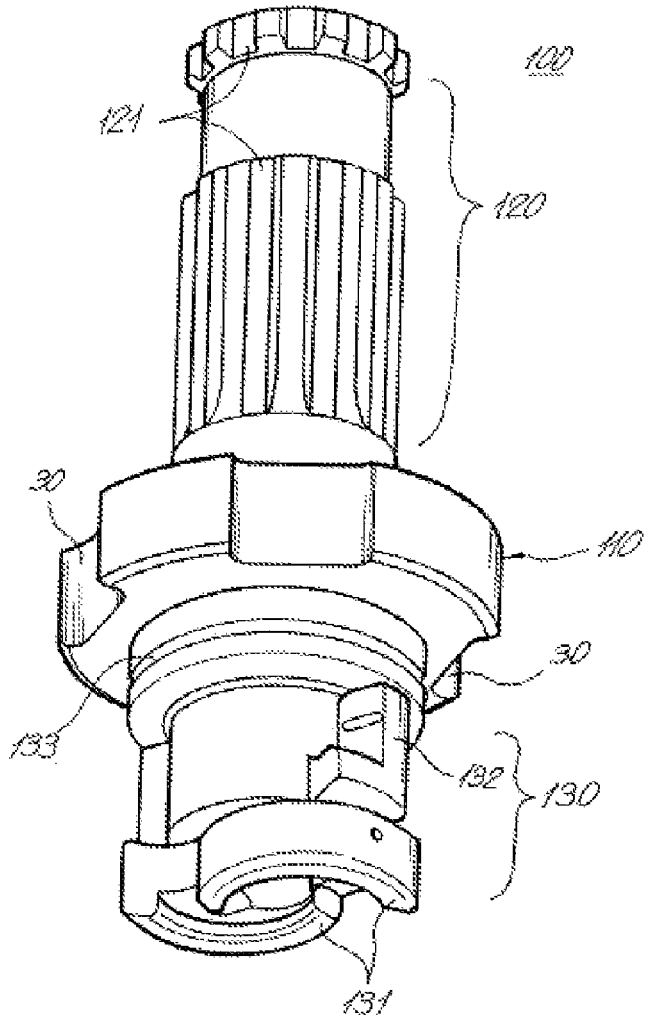
FIG. 2 is a view showing structure of a guide device 100 shown in FIG. 1.
Figure 3:
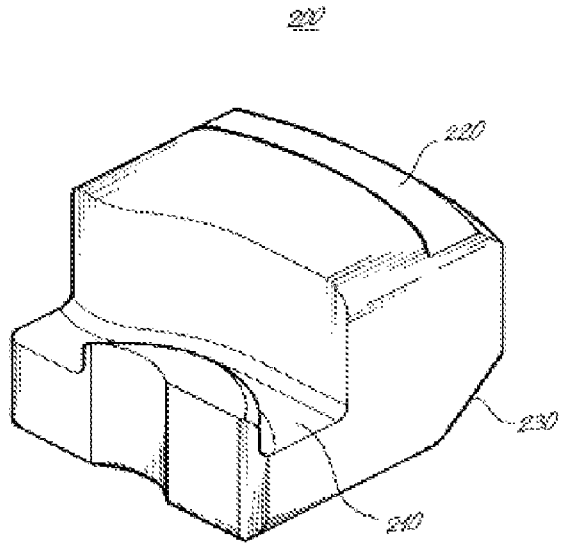
FIG. 3 is a structural view showing extending wings 200 shown in FIG. 1.
Figure 4:
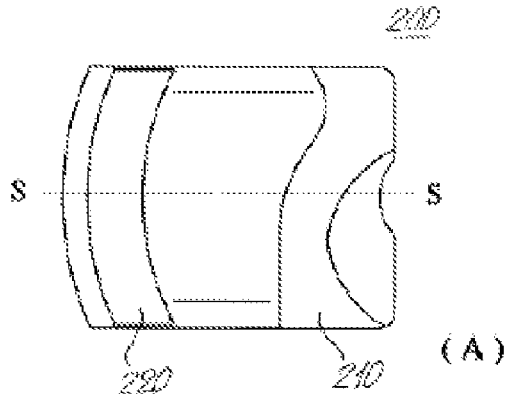
FIG. 4A is a planar view showing the extending wings 200.
FIG. 4B is a cross-sectional view of the extending wings taken along the line S-S.
Figure 4:
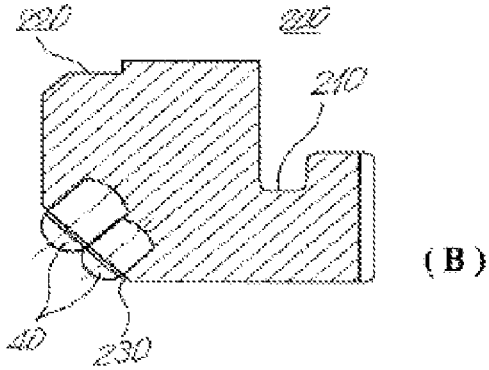
Figure 5:
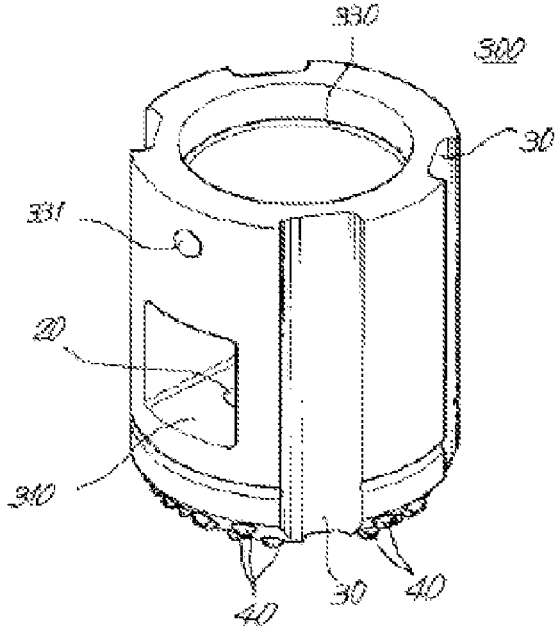
FIG. 5 is a structural view showing a pilot bit 300 shown in FIG. 1.

FIG. 1 is a cross-sectional view showing structure of a borehole drilling apparatus according to the present invention, FIG. 2 is a view showing structure of a guide device 100 shown in FIG. 1, FIG. 3 is a structural view showing extending wings 200 shown in FIG. 1, FIG. 4A is a planar view showing the extending wings 200, and FIG. 4B is a cross-sectional view of the extending wings taken along the line S-S, FIG. 5 is a perspective view showing a pilot bit 300 shown in FIG. 1, and FIG. 6A is a planar view of the pilot bit 300, FIG. 6B is a cross-sectional view of the pilot bit taken along the line S-S, FIG. 6C is a cross-sectional view of the pilot bit taken along the line S'-S'.

As shown in FIG. 1, the borehole drilling apparatus comprises a guide device 100 engaged with a striking device (not shown), extending wings 200 installed at a lower portion of the guide device 100 to extend the diameter of the borehole, and a pilot bit 300 for drilling the ground while supporting the extending wings 200. In an embodiment of the present invention, a ring-type pin 400 is constructed as pin engaging means for engaging the guide device 100 with the pilot bit 300.

At first, as shown in FIG. 2, the guide device 100 includes an upper shaft portion 120, a lower shaft portion 130 which have a smaller diameter, and a piston portion 110 having a relatively larger diameter than the upper and lower shaft portions. As shown in FIG. 1, the piston portion 110 is installed within a casing 10 while maintaining a small gap there-between so that it operates to strike an upper end of the a shoe 12 installed at a lower end of the casing 10 to thereby progress the casing 10 into the borehole. A plurality of sludge discharging grooves 30 are formed on the outer circumferential surface of the piston portion 110 for discharging the sludge such as soils, pebbles, and the like produced during the drilling process from the borehole. As shown in FIG. 1, an air hole 20 is formed along a center axis of the piston portion 110 while passing through the piston portion 110, the upper shaft portion 120, and the lower shaft portion 130 for supplying high pressure air along the longitudinal direction from the outside.

The upper shaft portion 120 is provided with shaft engaging grooves 121 formed on the outer circumferential surface thereof for engaging with the striking device (not shown), which is an upper structure of the drilling apparatus. Spiral projections 131 with curved surface are formed at the bottom of the lower shaft portion 130, in which the diameter of the curved surface increases progressively from the center, and a retaining protrusion 132 is formed on the outer circumference of the lower shaft portion 130. Also, a pin groove 133 is formed with which the ring-type pin 400 is engaged, along the outer circumferential surface at just below the piston portion 110, that is, an upper side of the lower shaft portion 130.

The extending wings 200 are configured as shown in FIGS. 3 and 4, a guide groove 210 is formed at the inside of the extending wings for engaging with the spiral projection 131 of the guide device 100. Also, a stepped surface 220 is formed on the outside upper surface of the extending wing 200, and an inclined surface 230 is formed at a lower corner of the extending wings. Further, a plurality of button tips 40 made of special steel are driven into the inclined surface 230 to facilitate the drilling work.

Figure 6:
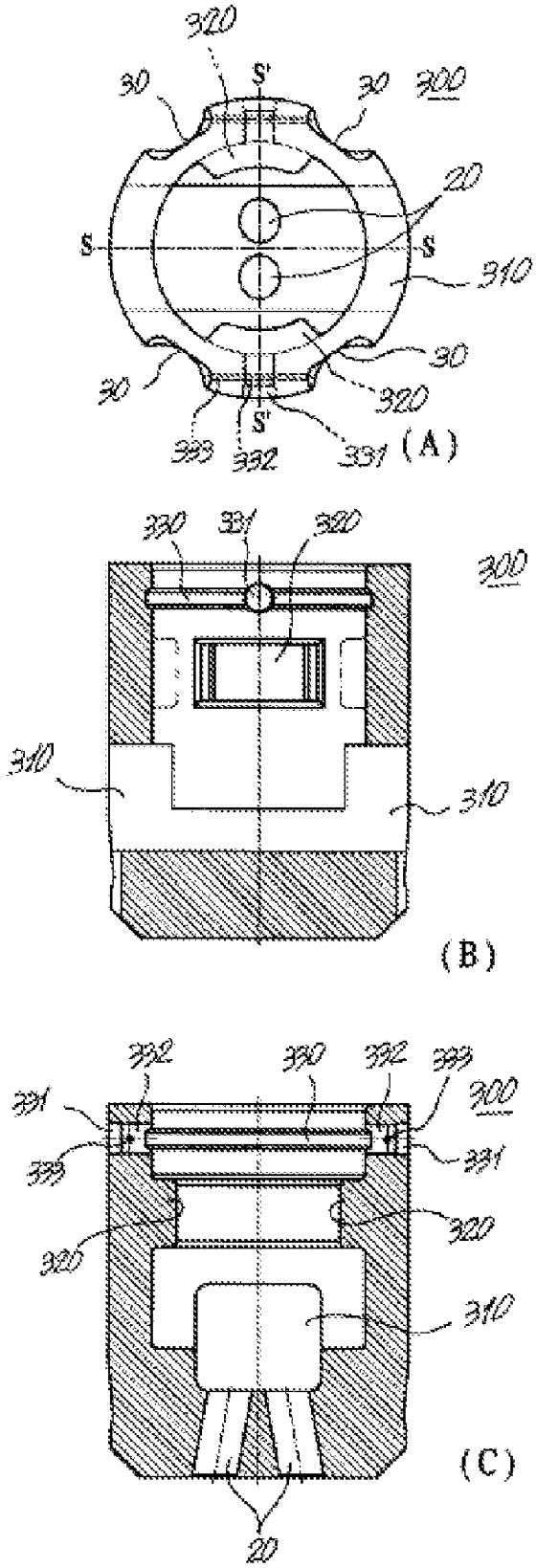
FIG. 6A is a planar view of the pilot bit 300.
FIG. 6B is a cross-sectional view of the pilot bit taken along the line S-S.
FIG. 6C is a cross-sectional view of the pilot bit taken along the line S'-S'.

Meanwhile, as shown in FIGS. 5 and 6, the pilot bit 300 is configured to be a cylindrical vessel shape, and the lower shaft portion 130 of the guide device 100 and the extending wings 200 are received in the pilot bit 300.

A rectangular-shaped window 310 for advancing and retracting the extending wing 200 is formed at a side of the pilot bit 300, a retaining step 320 is formed inwardly from an inner circumferential surface of the pilot bit to correspond to the retaining protrusion 132 of the guide device 100, and a pin groove 330 is formed at a position of the inner circumferential surface corresponding to a pin groove 133 of the lower shaft portion 130. The pin groove 330 is communicatively connected with the outside by a pin insertion hole 331. Also, an air hole 20 is formed at a lower surface of the pilot bit 300, and a plurality of sludge discharge grooves 30 are formed on the outer circumferential surface of the pilot bit, and button tips 40 are driven into the lower surface of the pilot bit.

Figure 7:
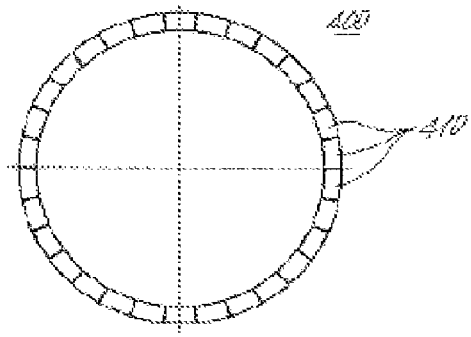
FIG. 7 is a view showing structure of a ring-type pin according to an embodiment of the present invention.

FIG. 7 shows structure of a ring-type pin 400 used in an embodiment of the present invention, in which a plurality of arc-shaped pins are combined to form a circle. The ring-type pin 400 is fit into a pin groove 133 formed at the outer circumferential surface of the lower shaft portion 130 of the guide device 100, and a pin hole is formed by the pin groove 330 defined at the inner circumferential surface of the pilot bit 300 to clamp the guide device 100 and the pilot bit 300. In this instance, each of the arc-shaped pins 410 are inserted into the pin hole respectively via the pin insertion hole 331 formed at the pin groove 330 of the pilot bit 300. A pin support element 332 is inserted into the pin insertion hole 331 so that the arc-shaped pins 410 cannot be separated from the pin holes, and a bolt (not shown) is engaged with a bolt hole 333 thereby to finish the clamping of the ring-type pin.

Figure 8:
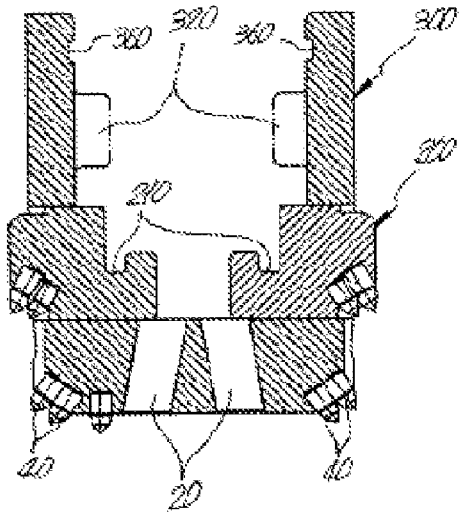
FIGS. 8 and 9 are views showing installing structure of the securing pin 400 according to another embodiment of the present invention.
Figure 9:
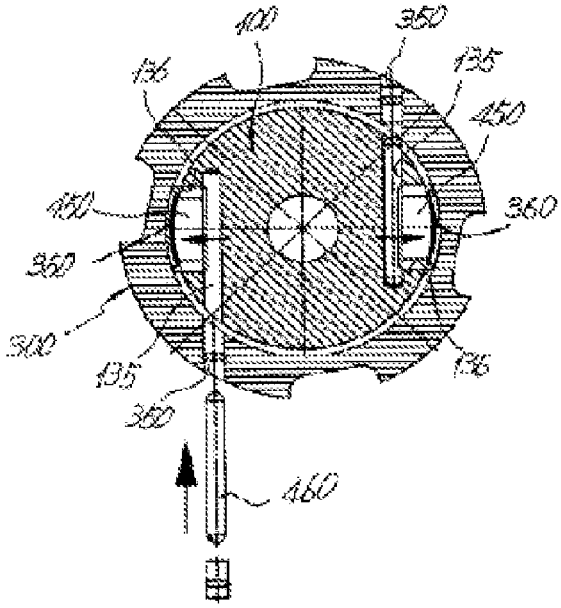

Meanwhile, FIG. 8 and FIG. 9 show different embodiments of the present invention, in which the pin engagement means for clamping the guide device 100 and the pilot bit 300 includes a securing pin 450 and a pin support rod 460 instead of the ring-type pin 400. FIG. 8 shows longitudinal cross-section of the extending wing 200 and the pilot bit 300, and FIG. 9 shows cross-section taken along the line S-S of FIG. 8. As shown in the drawings, a pin insertion hole 350 is formed obliquely at a side of the pilot bit 300, and a pin retaining groove 360 is formed on the inner circumferential surface of the pilot bit. Also, a pin insertion hole 135 extending from the pin insertion hole 350 is formed obliquely at the upper end of the lower shaft portion 130 of the guide device 100, and a pin receiving groove 136 is formed within the pin insertion hole 135 to correspond to the pin retaining groove 360.

In order to assemble the borehole drilling apparatus according to the embodiment of the present invention, the securing pin 450 is inserted into the pin receiving groove 136 of the guide device 100 at first, the guide device 100 is inserted into and engaged with the pilot bit 300, and then the pin support rod 460 is forcibly pushed into the insertion hole 135 via the pin insertion hole 350. In this instance, the pin support rod 460 pushes out the securing pin 450 so that it can be engaged with the pin retaining groove 360 of the pilot bit 300 to thereby clamp the guide device 100 and the pilot bit 300 to each other.

Figure 10:
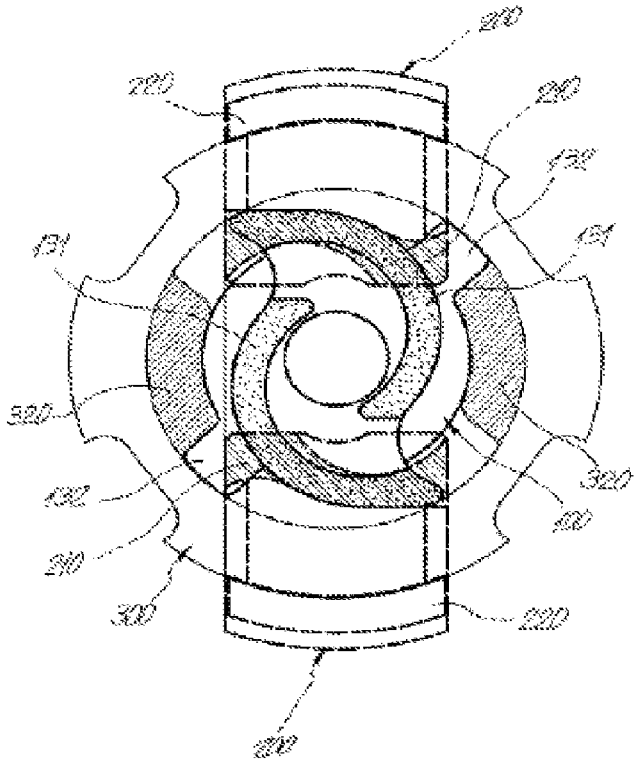
FIGS. 10 and 11 are views explaining an in-line driving method of the present invention.
Figure 11:
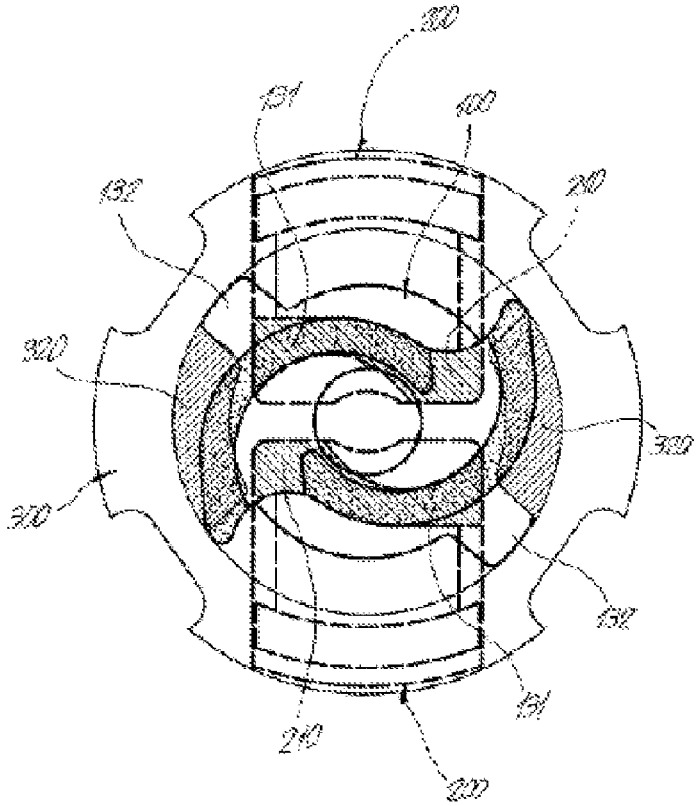

The in-line driving method of the borehole drilling apparatus of the present invention will now be described below. FIG. 10 and FIG. 11 are views for explaining the driving principle of the drilling apparatus in which two extending wings 200 are arranged linearly side by side according to an embodiment of the present invention.

At first, as shown in FIG. 10, the guide device 100 (represented by thick solid line) rotates clockwise to descend with the pilot bit 300 in a state where the extending wings 200 (represented by dotted thick line) are received within the pilot bit 300 (represented by thin solid line). When the lower surface of the pilot bit 300 begins to strike a bottom surface of the borehole, rotation of the pilot bit 300 will be suppressed by the frictional force, and if the guide device 100 continues to rotate at this state, the spiral projections 131 (represented by a dotted portion) rotates along the guide groove 210 (represented by reverse inclined lines) of the extending wing 200 in the direction enlarging radius to spread and extend the extending wings 200 to the outside of the wing advancing and retracting window 310. In this instance, the extending wing 200 is spread and extended linearly away from the center of the pilot bit 300 via the advancing and retracting window 310.

Then, as shown in FIG. 11, when the retaining protrusion 132 of the guide device 100 contacts the retaining step 320 (shown by inclined lines), spreading of the extending wings 200 is stopped, and rotation force of the guide device 100 is transmitted to the pilot bit 300 itself to rotate the guide device 100, the extending wing 200 and the pilot bit 300 integrally to carry out the drilling work. Sludge such as pebbles, sands and so on produced during the drilling work can be discharged via the sludge discharge hole 30 by means of the compressed air supplied from the air hole 20.

Meanwhile, the return process of the extending wing 200 for the borehole begins with reverse rotation and ascending of the guide device 100. In other words, as shown in FIG. 11, when the guide device 100 rotates counter-clockwise to ascend in a state where the extending wings 200 are spread, the stepped surface 220 of the extending wings 200 contacts with the lower end of a shoe 12 in the casing 10, and the rotation of the extending wing 200 for the borehole is suppressed by the frictional force. At this state, if the guide device continues to rotate reversely, the spiral projections 131 (represented by a dotted portion) move along the guide groove 210 of the extending wing 200 in the direction decreasing the radius to thereby return the extending wings 200 into the window 310 of the pilot bit 300. In this instance, the extending wings 200 return linearly to come close each other to the center of the pilot bit 300 via the advancing and retracting window 310 for the wings.

When the guide device 100 rotates reversely to contact with the retaining step 320 (shown by inclined solid lines), as shown in FIG. 11, the extending wings 200 finish returning, and the guide device 100, the extending wings 200 and the pilot bit 300 concurrently rotate to retract from the casing 10.

In the present invention, although it is preferable that two extending wings 200 are installed at both side as described in the above embodiment, three extending wings may be installed, if desired. In case of installing three extending wings 200, the driving principle is basically the same as that of installing two extending wings. However, the spiral projections 131 of the guide device 100 and the wing advancing and retracting window 310 of the pilot bit 300 should be installed to be three so that they can cope with three extending wings 200.

While the present invention has been described with reference to the preferred embodiments, the present invention is not restricted by the embodiments. It is to be appreciated that those skilled in the art can change or modify the embodiments without departing from the scope and spirit of the present invention. However, such variations and modifications are all pertained to the scope of the present invention.

INDUSTRIAL APPLICABILITY

As described above, according to the borehole drilling apparatus of the present invention, it is possible to carry out high load and high speed drilling work because the extending wings advance and retract in an in-line manner, and in particular, the sludge is not accumulated at the position where the extending wings advance and retract.

Also, it is possible to significantly reduce a working period required to finish the drilling of the borehole, considering that the conventional drilling apparatus has frequently stop operation and has been susceptible to disorder due to accumulation of the sludge.

In particular, when the sludge is accumulated between the extending wings to thereby block smooth returning of the extending wings, the whole drilling apparatus cannot be retracted from the borehole and it should be discarded, therefore, according to the present invention, it is possible to expect a reduction of the costs caused by the lost of the equipments.

What is claimed is:

1. A driving method of a borehole drilling apparatus comprising a guide device, wings for extending a borehole and a pilot bit, the driving method comprises the steps of:

suppressing rotation of the pilot bit by frictional force produced when the extending wings rotate and descend integrally with the guide device in a state where the extending wings are received in the pilot bit, and then a bottom surface of the pilot bit begins to strike a bottom surface of the borehole;

spreading the extending wings outwardly from a wing advancing and retracting window formed at a side of the pilot bit by movement of a plurality of spiral projections formed at a lower surface of the guide device along a plurality of guide grooves formed at a side of the extending wings in a direction of increasing radii of the spiral projections by rotational force of the guide device, when the guide device continues to rotate in a state where rotation of the pilot bit is suppressed;

drilling the borehole with integral rotation of the guide device, the extending wings and the pilot bit, after the extending wings stop spreading when a retaining protrusion formed on an outer circumference of the guide device is caught by a retaining step formed at an inner circumferential surface of the pilot bit;

suppressing rotation of the extending wings by frictional force produced when upper surfaces of the extending wings come into contact with a shoe of a casing to fit into the borehole, after the guide device rotates reversely and ascends upon spreading of the extending wings;

returning the extending wings into the wing advancing and extracting window of the pilot bit by movement of the spiral projections of the guide device along the guide grooves of the extending wings in a direction of decreasing radii of the spiral projections by rotational force of the guide device, when the guide device continues to rotate reversely in a state where rotation of the extending wings is suppressed; and retracting the guide device, the extending wings and the pilot bit from the casing while integrally rotating the guide device, the extending wings, and the pilot bit after stopping the extending wings, when the retaining protrusion formed on the outer circumference of the guide device contacts with the retaining step formed at the inner circumferential surface of the pilot bit.

2. A borehole drilling apparatus comprising:

an elongate guide device that includes, disposed along a center axis, an upper shaft portion, a piston portion, and a lower shaft portion, wherein (a) a guide device air hole passes along the center axis, (b) the piston portion includes a piston portion outer surface having a plurality of guide device sludge discharging grooves, and (c) the lower shaft portion includes a retaining protrusion and a plurality of spiral projections that include a curved surface with a variable radius;

a plurality of extending wings that include a guide groove that is configured to engage with the curved surface of a selected one of the plurality of spiral projections;

a pilot bit that includes a pilot bit air hole, a pilot bit outer surface having a plurality of pilot bit sludge discharging grooves, a concave structure having an inner surface, and a window formed in the inner surface, wherein (a) the concave structure is configured to receive the lower shaft portion of the guide device and the plurality of extending wings, (b) a retaining step extends from the inner surface, and (c) the retaining step is configured to restrict rotation of the guide device with respect to the pilot bit by engaging the retaining protrusion of the guide device;

a guide device pin groove that is formed in the lower shaft portion of the guide device;

a pilot bit pin groove that is formed in the inner surface of the concave structure of the pilot bit, and that is positioned so as to correspond to the guide device pin groove when the lower shaft portion of the guide device is received into the concave structure of the pilot bit; and a ring-type pin that is formed from a plurality of arc-shaped pins, and that is engaged with the guide device pin groove and the pilot bit pin groove.

3. A borehole drilling apparatus comprising:

an elongate guide device that includes, disposed along a center axis, an upper shaft portion, a piston portion, and a lower shaft portion, wherein (a) a guide device air hole passes along the center axis, (b) the piston portion includes a piston portion outer surface having a plurality of guide device sludge discharging grooves, and (c) the lower shaft portion includes a retaining protrusion and a plurality of spiral projections that include a curved surface with a variable radius;

a plurality of extending wings that include a guide groove that is configured to engage with the curved surface of a selected one of the plurality of spiral projections;

a pilot bit that includes a pilot bit air hole, a pilot bit outer surface having a plurality of pilot bit sludge discharging grooves, a concave structure having an inner surface, and a window formed in the inner surface, wherein (a) the concave structure is configured to receive the lower shaft portion of the guide device and the plurality of extending wings, (b) a retaining step extends from the inner surface, and (c) the retaining step is configured to restrict rotation of the guide device with respect to the pilot bit by engaging the retaining protrusion of the guide device;

a plurality of pilot bit pin insertion holes that are formed in the pilot bit, and that are formed obliquely with respect to the pilot bit outer surface;

a plurality of guide device pin insertion holes formed in the lower shaft portion of the guide device, wherein (a) the guide device pin insertion holes include an interior surface, and (b) when the lower shaft portion of the guide device is positioned within the concave structure of the pilot bit, the guide device pin insertion holes extend from the pilot bit pin insertion holes;

a pilot bit pin groove that is formed in the inner surface of the concave structure of the pilot bit;

a pin receiving groove formed on the interior surface of the guide device pin insertion holes, and that corresponds to the pilot bit pin groove when the lower shaft portion of the guide device is received into the concave structure of the pilot bit;

a securing pin that is engaged with the pin receiving groove and the pilot bit pin groove; and a pin support rod that is at least partially positioned within (a) a selected one of the pilot bit pin insertion holes, and (b) a selected one of the guide device pin insertion holes.

4. The borehole drilling apparatus of claim 2, wherein there are at least three extending wings.

* * * * *